United States Patent [19]

Suzuki et al.

[11] 4,094,386

[45] June 13, 1978

[54] SPEED COMMAND GENERATOR FOR ELEVATOR

[75] Inventors: Kazuo Suzuki, Katsuta; Hiroyuki Kataoka, Nakamachi, both of Japan

[73] Assignee: Hitachi, Ltd., Japan

[21] Appl. No.: 682,043

[22] Filed: Apr. 30, 1976

[30] Foreign Application Priority Data

May 7, 1975 Japan ..... 50-54986

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,643,762 | 2/1972 | Schibli | 187/29 |
| 3,670,851 | 6/1972 | Shima | 187/29 |
| 3,759,350 | 9/1973 | Caputo et al. | 187/29 |
| 3,972,389 | 8/1976 | Faup | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

A speed command voltage is generated which increases in proportion to the lapse of time so as to increase the speed of an elevator car at a constant acceleration after starting. Another speed command voltage is generated which decreases with the reduction in the distance between the position of the travelling elevator car and the target floor position so as to decrease the speed of the elevator car at a constant deceleration. The speed patterns provided by these speed command voltages are joined together to provide a continuous speed pattern for the elevator car instructed to travel to arrive at the target floor. In order to ensure shock-free operation of the elevator car at the joint between these speed command voltages, the speed command voltages in accordance with respective speed patterns for use in acceleration and deceleration are compared with each other, and the increase in the speed command voltage for acceleration is ceased when the difference therebetween attains a predetermined value. The speed command voltage is maintained constant at this level to provide a constant-speed command voltage. Then, the constant-speed command voltage and speed command voltage for deceleration are applied to a lower-level signal passing circuit, in which two input signals are compared with each other and the lower level signal of them only is passed, to obtain a completely continuous speed pattern for the elevator car. A reference command voltage is generated, which increases up to a predetermined level with the increase in the speed command voltage for acceleration, and the rate of increase of which decreases gradually upon attainment of such a level. This reference command voltage is used to maintain always constant the length of time of this constant-speed command voltage. The increase in the speed command voltage for acceleration is ceased to obtain the constant-speed command voltage when the difference between the speed command voltage for acceleration and the speed command voltage for deceleration is reduced to a value less than that of the reference command voltage.

9 Claims, 9 Drawing Figures

SPEED COMMAND GENERATOR FOR ELEVATOR

This invention relates to improvements in speed command generators for elevators.

An elevator car is designed to travel with limited acceleration and deceleration, and the rate of change of acceleration and deceleration is also limited, so that passengers can ride in the elevator car in comfort. Further, it is required that the operating period of time of the elevator car be as short as possible in spite of the above limitations in order that the passengers can be conveyed to their target floors as quickly as possible. Therefore, the elevator car drive motor drives the elevator car according to a speed pattern as described below. In the starting and accelerating stage of the elevator car, a speed command voltage for acceleration is generated so that the speed of the elevator car can be increased at a constant acceleration with the lapse of time, while in the decelerating stage of the elevator car, a speed command voltage for deceleration is generated so that the speed of the elevator car can be decreased at a constant deceleration with the reduction in the distance between the position of the travelling elevator car and the target floor position. The acceleration and deceleration are selected to be allowable maximum values. These speed command voltages for acceleration and deceleration are passed through a lower-level signal passing circuit, in which two input signals are compared with each other and only the lower level signal is passed, to obtain a continuous speed pattern ranging from the speed pattern for the acceleration period of time to the speed pattern for the deceleration period of time. In such a continuous speed pattern, however, there occurs an abrupt change from the positive acceleration to the negative one at the point of change-over from the speed pattern for the acceleration period of time to the speed pattern for the deceleration period of time. That is, the rate of change of acceleration becomes excessively great at this change-over point, and a shock will be imparted to the passengers in the elevator car. It is therefore a common practice to interpose a constant-speed pattern between the speed pattern for the acceleration period of time and the speed pattern for the deceleration period of time.

A method is commonly known in which the speed command voltage for deceleration is compared with the speed command voltage for acceleration so as to detect the point of transition from the speed pattern for the acceleration period of time to the constant-speed pattern when the difference therebetween attains a predetermined constant value. According to this known method, however, the length of time, during which the elevator car runs with the constant-speed pattern, differs depending on whether the elevator car travels a long distance or a short distance until it arrives at the target floor. Thus, the passengers will not always enjoy a comfortable ride, and the elevator car will not always run for shortest possible length of time until it arrives at the target floor.

It is therefore a primary object of the present invention to provide an improved speed command generator for an elevator which ensures always the desired comfortable ride at whatever distance and provides the shortest possible length of time for the elevator car to arrive at the target floor.

One of the important features of the present invention resides in an improvement in a speed command generator for an elevator comprising means for generating a speed command voltage for acceleration increasing in proportion to the lapse of time thereby increasing the speed of an elevator car at a constant acceleration after starting, means for generating a speed command voltage for deceleration decreasing with the reduction in the distance between the position of the travelling elevator car and the target floor position thereby decreasing the speed of the elevator car at a constant deceleration, and means for comparing the speed command voltage for acceleration with the speed command voltage for deceleration to provide a constant-speed command voltage when the difference therebetween attains a predetermined reference value, thereby to drive the elevator car according to a continuous speed pattern consisting of a sequence of speed patterns provided by the speed command voltage for acceleration constant-speed command voltage and speed command voltage for deceleration, wherein the improvement comprises means for generating another command voltage varying depending on the variation of the speed command voltage for acceleration so that this command voltage can be used to provide the predetermined reference value.

Other objects, features and advantages of the present invention will become apparent from the following detailed description of preferred embodiments thereof taken in conjunction with the accompanying drawing, in which.

Figure 1:
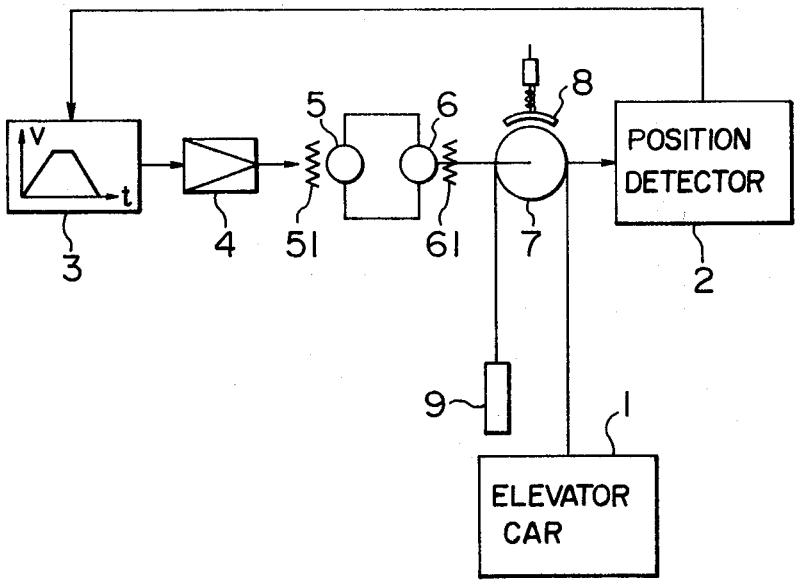
FIG. 1 is a block diagram showing the general structure of an elevator speed control system to which the present invention is applied.

Referring to FIG. 1 which is a block diagram of an elevator speed control system, a position detector 2 detects the position of an elevator car 1 which is suspended together with a counterweight 9 by a rope trained around a sheave 7. A brake 8 is associated with the sheave 7. The output of the position detector 2 is applied to a speed command generator 3. In response to the application of the output of the position detector 2, the speed command generator 3 generates a speed command voltage which is determined depending on the distance between the detected position of the elevator car 1 and the target floor position. The output of the speed command generator 3 is applied through an amplifier 4 to a field coil 51 of a generator 5 of a Ward-Leonard system for controlling the rotating speed of a drive motor 6 having a field coil 61. Thus, the travelling speed of the elevator car 1 driven by the drive motor 6 through the sheave 7 is controlled according to the speed pattern provided by the output of the speed command generator 3.

The present invention relates to an improvement in the prior art speed command generator 3 of the type shown in FIG. 1. This prior art speed command generator 3 comprises means for generating a first speed command voltage or signal for deceleration VD varying with the reduction in the distance between the physical position of the elevator car 1 and the target floor position, means for generating a second speed command voltage or signal for acceleration VA varying with the lapse of time after the application of the starting instruction to the elevator car 1, and means for comparing these two speed command voltages with each other to detect the difference therebetween.

Figure 2:
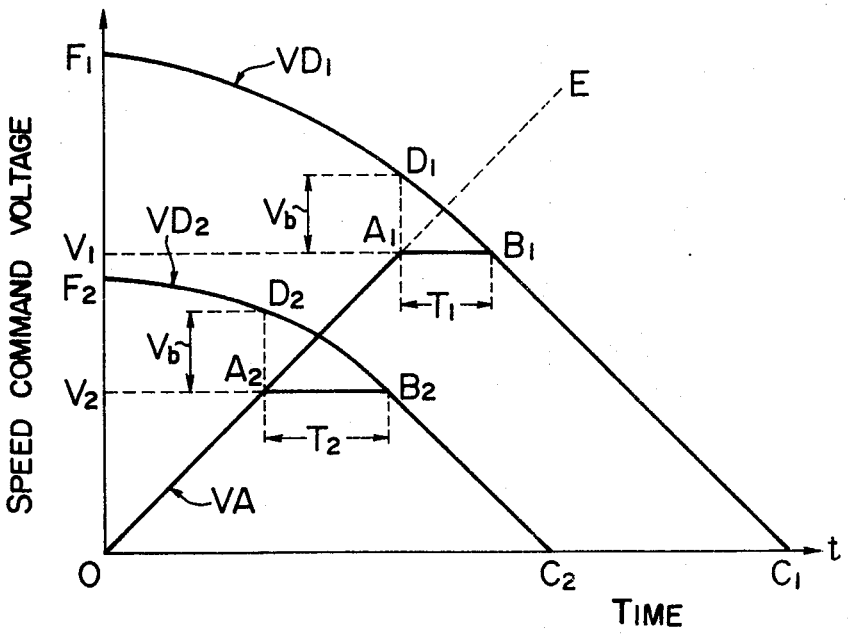
FIG. 2 is a time vs. speed pattern diagram showing the basic operating principle of a prior art speed command generator.

Referring to FIG. 2, a curve $\overline{F_1D_1B_1C_1}$ connecting points $F_1$, $D_1$, $B_1$ and $C_1$ and designated by $VD_1$ represents one form of the speed command voltage for deceleration VD. Another curve $\overline{OA_2A_1E}$ connecting points O, $A_2$, $A_1$ and E represents one form of the speed command voltage for acceleration VA. In FIG. 2, the combination of the curves $\overline{F_1D_1B_1C_1}$ and $\overline{OA_2A_1E}$ provides a curve $\overline{OA_1B_1C_1}$ which represents one of continuous speed patterns used hitherto for driving the elevator car 1. According to this continuous speed pattern, the speed command voltage VA increases at a constant rate along the curve $\overline{OA_2A_1E}$ toward the curve $\overline{F_1D_1B_1C_1}$ representing the speed command voltage $VD_1$ until the point $A_1$ is reached, at which the voltage level is $V_1$ and the difference $\overline{D_1A_1}$ between the speed command voltages $VD_1$ and VA is a predetermined constant value Vb. When the point $A_1$ is reached, a signal is applied to the speed command generator to maintain the speed command voltage VA at the voltage level $V_1$, and this voltage level $V_1$ is kept unchanged to provide a constant-speed pattern $\overline{A_1B_1}$. Then, when the point $B_1$ is reached at which the voltage level is also $V_1$, the voltage decreases along the curve $\overline{B_1C_1}$ representing the speed command voltage $VD_1$. The continuous speed pattern represented by the curve $\overline{OA_1B_1C_1}$ is obtained in the manner above described.

In this continuous speed pattern, the length of time $T_1$ of the constant-speed pattern $\overline{A_1B_1}$ must be maintained at a constant value T which is determined from the viewpoints of avoiding impartation of an uncomfortable shock to the passengers in the elevator car. Thus, in the case of another continuous speed pattern given by the curve $\overline{OA_2B_2C_2}$ too, the length of time $T_2$ of the constant-speed pattern $\overline{A_2B_2}$ must also be maintained at the constant value T. This is because the elevator car can arrive at the target floor with the shortest possible length of time within the allowable range of the rate of change of acceleration and deceleration only when the relation $T_1 = T_2 = T$ is satisfied. Suppose that the passengers in the elevator car feel comfortable to ride when the elevator car is driven according to the continuous speed pattern $\overline{OA_1B_1C_1}$ in FIG. 2, then the length of time required for the elevator car to arrive at the target floor will be extended by the amount corresponding to the difference between $T_2$ and $T_1$ ($T_2 > T_1$) in the case of the continuous speed pattern $\overline{OA_2B_2C_2}$. Thus, in this latter case, the speed command voltage for acceleration VA must be increased beyond the point $A_2$ of voltage level $V_2$. Suppose, on the other hand, that the continuous speed pattern $\overline{OA_2B_2C_2}$ meets the maximum allowable rate of change of acceleration from the aspect of shock-free operation, that is, the length of time $T_2$ is selected to be optimum, then the passengers will feel uncomfortable when the elevator car is driven according to the continuous speed pattern $\overline{OA_1B_1C_1}$.

Figure 3:
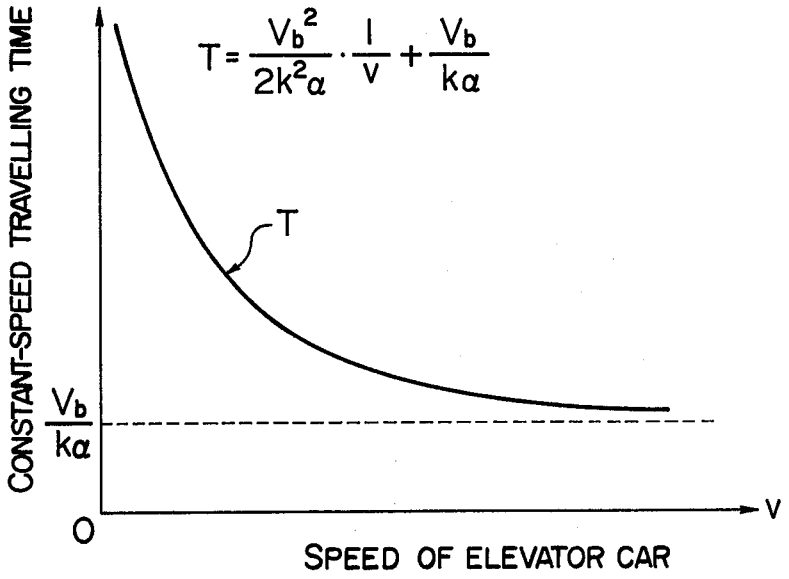
FIG. 3 is a graph showing how the length of time of the constant-speed command voltage shown in FIG. 2 varies relative to the variation of the speed of the elevator car.

The length of time T, during which the elevator car is driven according to the speed pattern, would vary relative to the variation of the speed $v$ of the elevator car in a manner as shown in FIG. 3, provided that Vb is constant.

Suppose now that the relation between the speed command voltage V and the speed $v$ of the elevator car is given by $V = kv$ where $k$ is a proportional constant. Then, the speed command voltage for deceleration VD is expressed as $$VD = k\sqrt{2ax} \tag{1}$$

where $a$ is the acceleration and deceleration of the elevator car, and $x$ is the distance between the existing position of the elevator car and the target floor position. The speed command voltage for acceleration VA varying with time in the elevator car accelerating stage is expressed as $$VA = kat \tag{2}$$

where $t$ is the time. When the speed command voltage for acceleration VA increases up to the point $A_1$, the level of the speed command voltage for deceleration $VD_1$ at this time is given by $V_1 + V_b$. From the equation (1), the distance $X_{A1}$ between the position of the elevator car corresponding to the point $A_1$ and the target floor position is given by $$X_{A1} = \frac{1}{2} \cdot \frac{(V_1 + V_b)^2}{k^2 a} \tag{3}$$

The distance $X_{\overline{A_1B_1}}$ to be traveled subsequently by the elevator car according to the speed pattern $\overline{A_1B_1}$ is given by $$X_{\overline{A_1B_1}} = \frac{V_1}{k} \cdot T \tag{4}$$

Therefore, the distance $X_{B1}$ between the position of the elevator car corresponding to the point $B_1$ on the speed pattern $\overline{A_1B_1}$ and the target floor position is given by $$\begin{aligned} X_{B1} &= X_{A1} - X_{\overline{A_1B_1}} \\ &= \frac{1}{2} \cdot \frac{(V_1 + V_b)^2}{k^2 a} - \frac{V_1}{k} \cdot T \end{aligned} \tag{5}$$

Further, from the equation (1), this distance $X_{B1}$ is also given by $$X_{B1} = \frac{1}{2} \cdot \frac{V_1^2}{K^2 a} \tag{6}$$

Therefore, from the equations (5) and (6), $V_b$ is expressed as $$V_b = -V_1 + \sqrt{V_1^2 + 2k\alpha TV_1} \quad (7)$$

Figure 4:
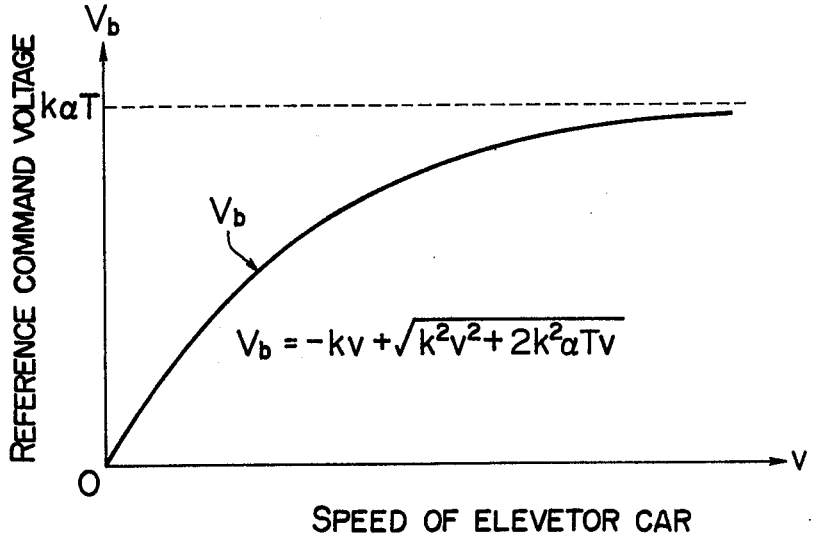
FIG. 4 is a graph showing how the reference command voltage shown in FIG. 2 varies relative to the speed of the elevator car according to the basic operating principle of the present invention.

This equation (7) can be expressed as $$V_b = -kv_1 + \sqrt{k^2v_1^2 + 2k^2\alpha Tv_1} \quad (8)$$

where $v_1$ represents the speed of the elevator car corresponding to the speed command voltage $V_1$. FIG. 4 is a graph showing the relation between the value of $V_b$ obtained from the equation (8) and the speed $v$ of the elevator car. It will be seen from FIG. 4 that the reference command voltage $V_b$ must not be constant but must change relative to the speed of the elevator car in order that the length of time T, during which the speed command voltage is kept constant or stabilized along the speed pattern $\overline{A_1B_1}$, can be maintained at the same value in all the continuous speed patterns.

In the prior art speed command generator, this length of time T has varied relative to the speed of the elevator car in the manner shown in FIG. 3 due to the fact that the value of the reference command voltage $V_b$ has been fixed. More precisely, the following equation (9) is obtained when the equations (5) and (6) are solved for T:

$$T = \frac{V_b^2}{2k\alpha} \cdot \frac{1}{v} + \frac{V_b}{k\alpha} \quad (9),$$

and the value of T varies in the manner shown in the graph of FIG. 3.

Figure 5:
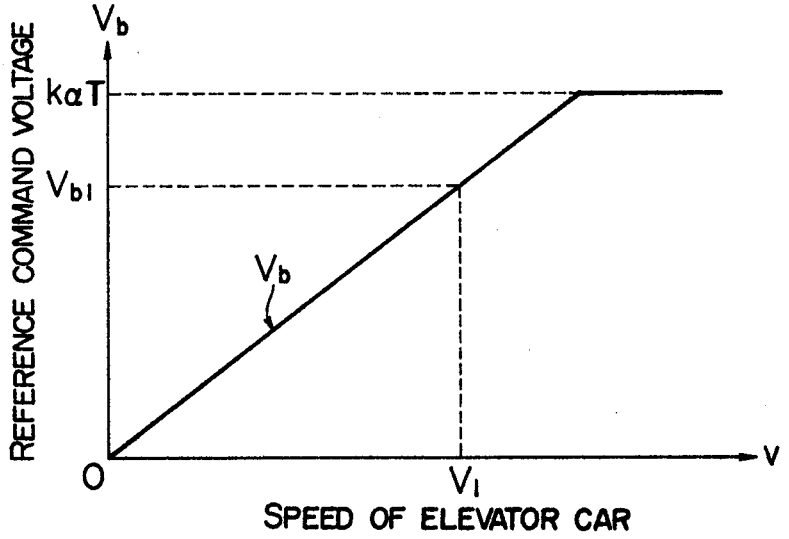
FIG. 5 is a view similar to FIG. 4, but showing a modified form of the curve shown in FIG. 4.

As described with reference to FIG. 4, the reference command voltage $V_b$ given by the equation (8) must vary in the form of a curve in relation to the speed of the elevator car. However, the merit of the present invention can be sufficiently exhibited even when the curve shown in FIG. 4 may be simplified in a manner as shown in FIG. 5 in which it will be seen that $V_b$ is varied linearly. Preferred embodiments of the speed command generator according to the present invention will therefore be described with reference to the case in which the reference command voltage $V_b$ is varied in the manner shown in the graph of FIG. 5 in generating the continuous speed pattern.

Figure 6:
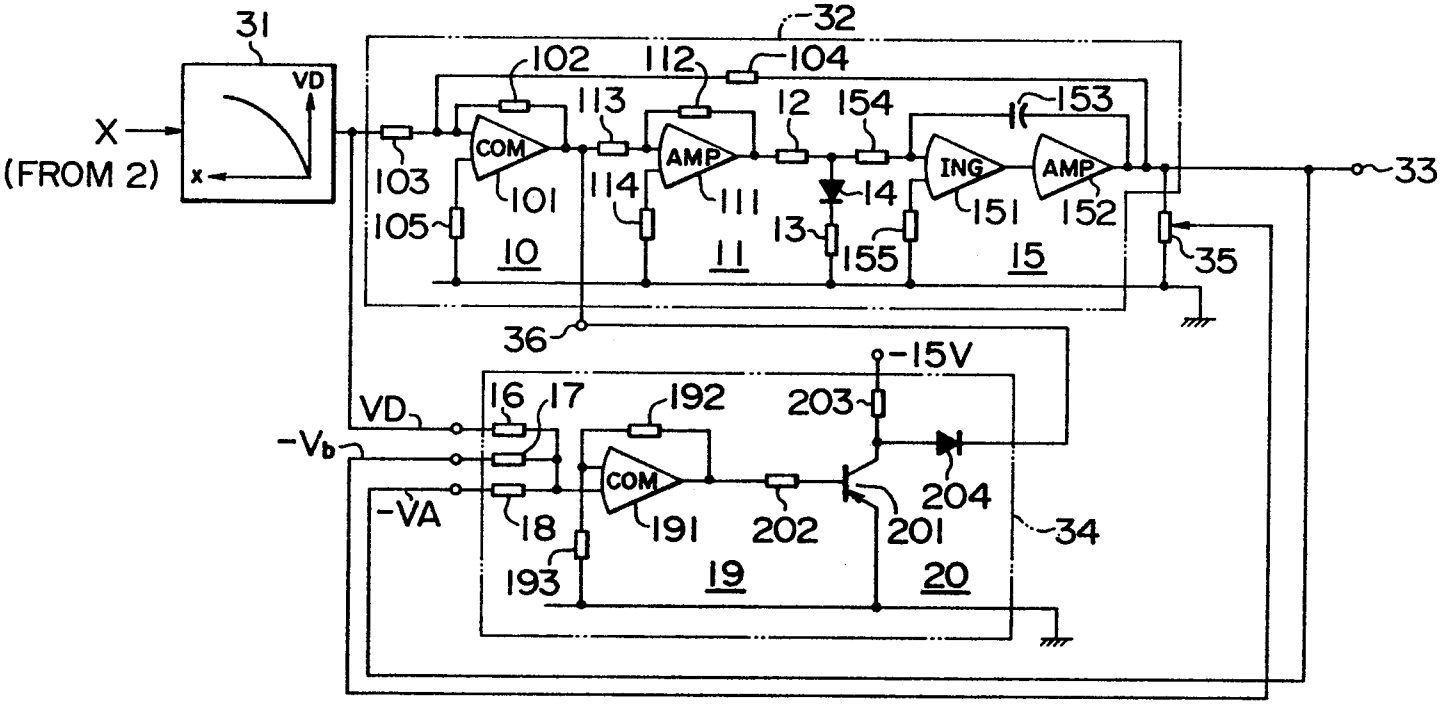
FIG. 6 is an electrical circuit diagram of a preferred embodiment of the speed command generator according to the present invention.

FIG. 6 is a circuit diagram of a preferred embodiment of the speed command generator according to the present invention when applied to the elevator speed control system shown in FIG. 1. Referring to FIG. 6, the output of the position detector 2 in FIG. 1 is applied to a first speed command generating circuit or speed command for deceleration generating circuit 31 which is a position-voltage transducer. This detector output is representative of the distance $x$ between the detected position of the elevator car 1 and the target floor position. The position-voltage transducer 31 delivers a voltage signal corresponding to the speed command voltage for deceleration $VD = k\sqrt{2\alpha x}$ given by the equation (1).

The output of the position-voltage transducer 31 is applied to an integrating circuit 32 including means for generating an output corresponding to the speed command voltage for acceleration VA in the accelerating stage of the elevator car 1. A sign-inverting comparator 10 produces a negative output when the result of comparison between the inputs is positive, and is composed of an amplifier 101, a feedback resistor 102, input resistors 103 and 104, and a grounding resistor 105. A sign-inverting amplifier 11 is composed of an amplifier 111, a feedback resistor 112, an input resistor 113, and a grounding resistor 114. A sign-inverting integrator 15 is composed of amplifiers 151 and 152, an integrating capacitor 153, an input resistor 154, and a grounding resistor 155. Further, the integrating unit 32 includes resistors 12 and 13 and a diode 14. The output of the integrating circuit 32 appears at an output terminal 33.

In the starting stage of the elevator car 1, the position-voltage transducer 31 applies the speed command voltage for deceleration VD to the comparator 10, and this speed command voltage for deceleration VD is compared in the comparator 10 with the output appearing at the output terminal 33 of the integrating circuit 32. However, no output appears at this time at the output terminal 33 in this stage. As a result, the comparator 10 saturates immediately, and a negative voltage of saturation level appears from the comparator 10 to be applied to the sign-inverting amplifier 11. The sign of this input is inverted by the sign-inverting amplifier 11, and an amplified constant positive voltage is applied to the sign-inverting integrator 15. The sign-noninverting integrator 15 integrates this constant positive voltage with the time constant determined by the C-R combination, and an output corresponding to the speed command voltage for acceleration VA increasing at a constant rate appears in inverted polarity at the output terminal 33. It will therefore be seen that this integrating circuit 32 operates as a second speed command generating circuit which generates the speed command voltage for acceleration VA in the starting and accelerating stage of the elevator car.

The speed command generator according to the present invention comprises further a comparing circuit 34 which is provided with three input terminals to which the speed command voltage for deceleration VD, speed command voltage for acceleration VA and reference command voltage $V_b$ are applied respectively. The speed command voltage for deceleration VD is applied from the position-voltage transducer 31 to a sign-noninverting comparator 19 in the comparing circuit 34 through an input resistor 16. The speed command voltage for acceleration VA of inverted polarity appearing at the output terminal 33 of the integrating circuit 32 is applied to the sign-noninverting comparator 19 through another input resistor 18. Further, the speed command voltage for acceleration VA of inverted polarity is divided by a variable resistor 35 to provide a voltage of inverted polarity which is applied to the sign-noninverting comparator 19 through another input resistor 17. This voltage is proportional to the speed command voltage for acceleration VA and provides the reference command voltage $V_b$ which varies in the manner shown in FIG. 5. The sign-noninverting comparator 19 is composed of an operational amplifier 191, a feedback resistor 192, and a grounding resistor 193. A switching circuit 20 is composed of a transistor 201, a base resistor 202, a collector resistor 203, and a diode 204.

The sign-noninverting comparator 19 produces a positive output voltage when the sum of the three inputs is positive, that is, when $VD + (-VA) + (-V_b) > 0$, while the output thereof turns abruptly into a negative voltage when the sum of the three inputs becomes negative, that is, when $VD + (-VA) + (-V_b) < 0$. Therefore, when the output voltage $-VA$ of the integrator 15 increases to such an extent that the sum $VD + (-VA)$ becomes less than the reference command voltage $V_b$, a negative voltage is applied to the base of the transistor 201 to turn on the same. As a result, the voltage level at an output terminal 36 of the comparing circuit 34 is increased to the level of ground potential, and an input of ground potential level is applied to the integrator 15. The capacitor 153 in the integrator 15 holding the charge stored therein acts to maintain constant the output voltage appearing at the output terminal 33 of the integrating circuit 32.

Then, when the output voltage of the position-voltage transducer 31, that is, the speed command voltage for deceleration VD decreases to reduce the output voltage appearing at the output terminal 33 of the integrating circuit 32, the comparator 10 saturates now in the positive direction and starts to produce a positive voltage. The amplifier 11 inverts the polarity of this positive voltage input and applies a negative output to the integrator 15. In this case, therefore, an output voltage which decreases with the reduction of the speed command voltage for deceleration VD appears now at the output terminal 33 of the integrating circuit 32.

Figure 7:
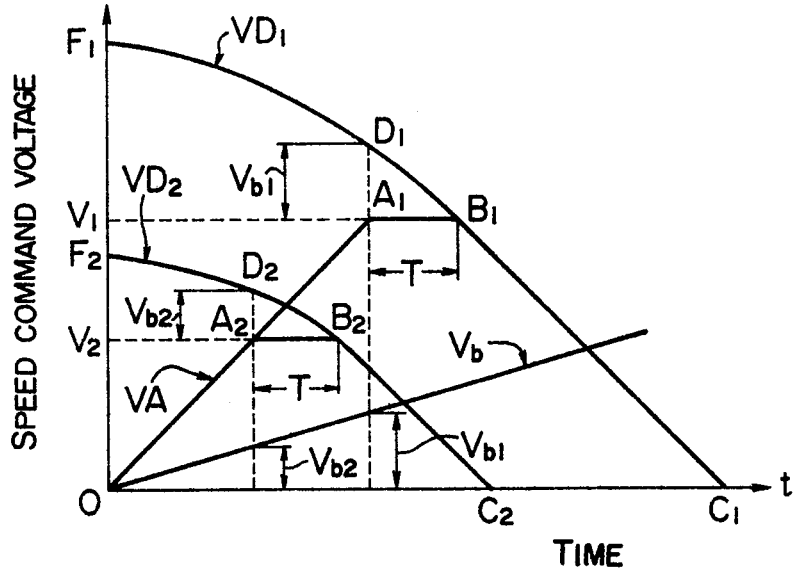
FIG. 7 is a time vs. speed pattern diagram showing the operation of the speed command generatar shown in FIG. 6.

The manner of continuous speed command generation will be described with reference to FIG. 7 when the present invention is applied to the elevator speed control system shown in FIG. 1. In response to the application of the starting instruction to the elevator car 1, the position detector 2 detects the distance $x$ between the existing position of the elevator car 1 and the target floor position and applies the corresponding output to the position-voltage transducer or first speed command generating circuit 31. In response to the application of the detector output representative of the distance $x$, the speed command voltage for deceleration $VD_1$ given by the equation (1) appears from the first speed command generating circuit 31 and starts to decrease with time from a point $F_1$ along a curve $\overline{F_1D_1B_1C_1}$ as shown in FIG. 7. At the time corresponding to the point $F_1$, the speed command voltage for acceleration VA does not appear still from the integrating circuit 32 which acts as the second speed command generating circuit in the elevator car starting and accelerating stage, and the reference command voltage $V_b$ does not also appear. It is apparent, therefore, that the relation $VD_1 + (-VA) + (-V_b) > 0$ holds at this time. Due to the fact that the sum of the three inputs to the comparing circuit 34 is positive, a negative output voltage appears at the output terminal 36 of the comparing circuit 34, and the speed command voltage output for acceleration VA appears from the second speed command generating circuit 32 and starts to increase with time along a line $\overline{OA_2A_1}$ at the rate of increase given by the equation (2). When the output VA of the second speed command generating circuit 32 increases up to the point $A_1$ at which the voltage value is $V_1$, the reference command voltage $V_b$ varying with the increase in the speed command voltage for acceleration VA has a value $V_{b1}$. In the meantime, the output $VD_1$ of the first speed command generating circuit 31 decreases to the point $D_1$ corresponding to the point $A_1$ on the time axis, and at this point $D_1$, the voltage value thereof is given by $(V_1 + V_{b1})$. At this time, therefore, $VD_1 + (-VA) + (-V_b) = (V_1 + V_{b1}) + (-V_1) + (-V_{b1}) = 0$, meaning that the sum of the three inputs to the comparing circuit 34 is now zero. As a result, the ground potential voltage appears now at the output terminal 36 of the comparing circuit 34, and the output VA of the second speed command generating circuit 32 is stabilized at the voltage level $V_1$ and kept constant at this voltage level $V_1$ during the length of time T corresponding to the line $\overline{A_1B_1}$.

At the point $B_1$, the output appearing at the output terminal 33 of the integrating circuit 32 starts to decrease with time along the curve $\overline{B_1C_1}$ due to the fact that the polarity of the input to the integrator 15 in the integrating circuit 32 is inverted with the decrease of the output $VD_1$ of the first speed command generating circuit 31 along the curve $\overline{B_1C_1}$. In this manner, the elevator car 1 travels to arrive at the target floor according to the continuous speed pattern represented by $\overline{OA_1B_1C_1}$.

Similarly, the elevator car 1 travels according to another continuous speed pattern represented by $\overline{OA_2B_2C_2}$ in FIG. 7 when the distance $x$ is shorter than that above described. In this case, the reference command voltage $V_b$ used for comparing the speed command voltage for deceleration VD with the speed command voltage for acceleration VA has a value $V_{b2}$ smaller than $V_{b1}$, since the output VA of the second speed command generating circuit 32 is stabilized and kept constant at a voltage level $V_2$ lower than $V_1$.

In the present invention, the reference command voltage $V_b$ is obtained by dividing the voltage VA by the variable resistor 35. Therefore, the reference command voltage $V_b$ can be varied to follow the variation of the voltage VA as seen in the graph of FIG. 5 so as to attain the aforementioned object of the present invention.

According to the present invention, the reference command voltage $V_b$ used for comparing the speed command voltage for deceleration VD with the speed command voltage for acceleration VA is varied relative to the speed $v$ of the elevator car in the manner given by the equation (8), so that the stabilized voltage level in all the speed patterns can be suitably varied depending on the distance $x$ between the existing position of the elevator car and the target floor position to give passengers a comfortable ride in all cases. Therefore, the length of time T of the stabilized voltage level can be maintained constant in all the speed patterns thereby improving the operating efficiency of the elevator.

Figure 8:
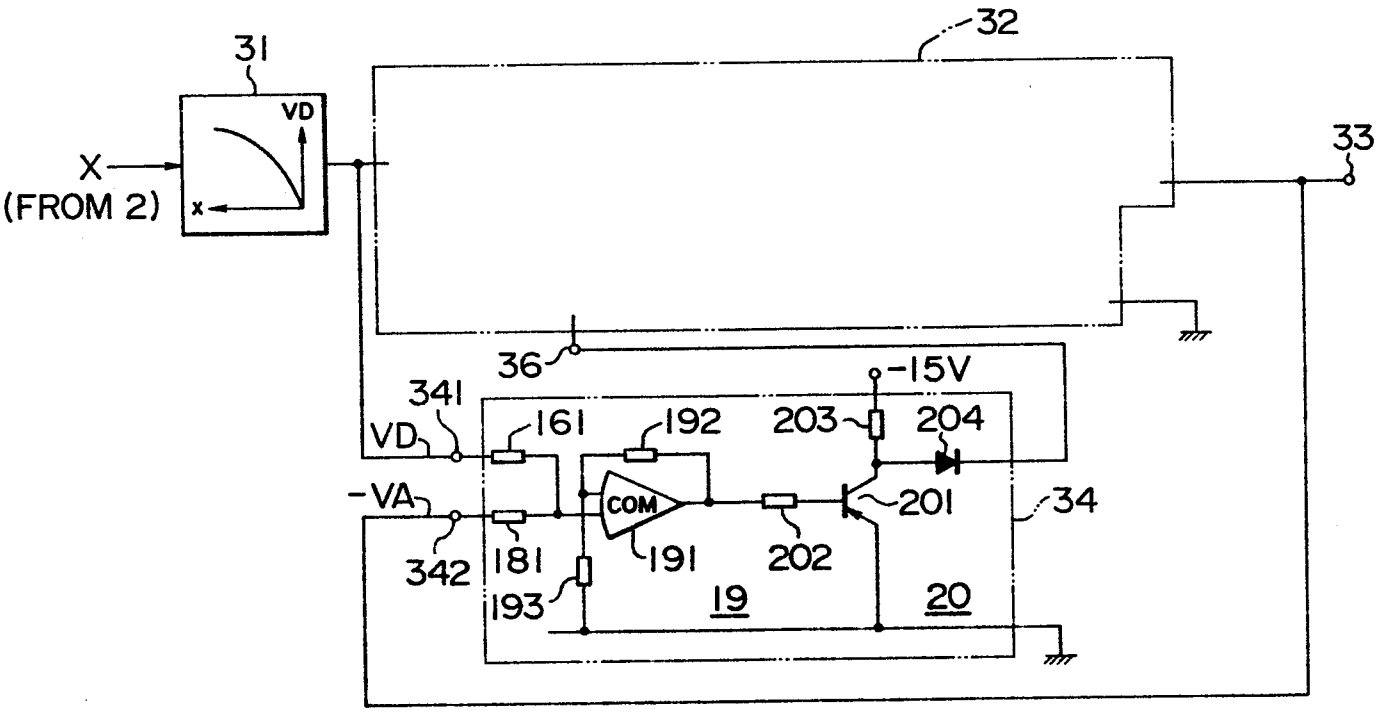
FIG. 8 is an electrical circuit diagram of a modification of the speed command generator shown in FIG. 6.
Figure 9:
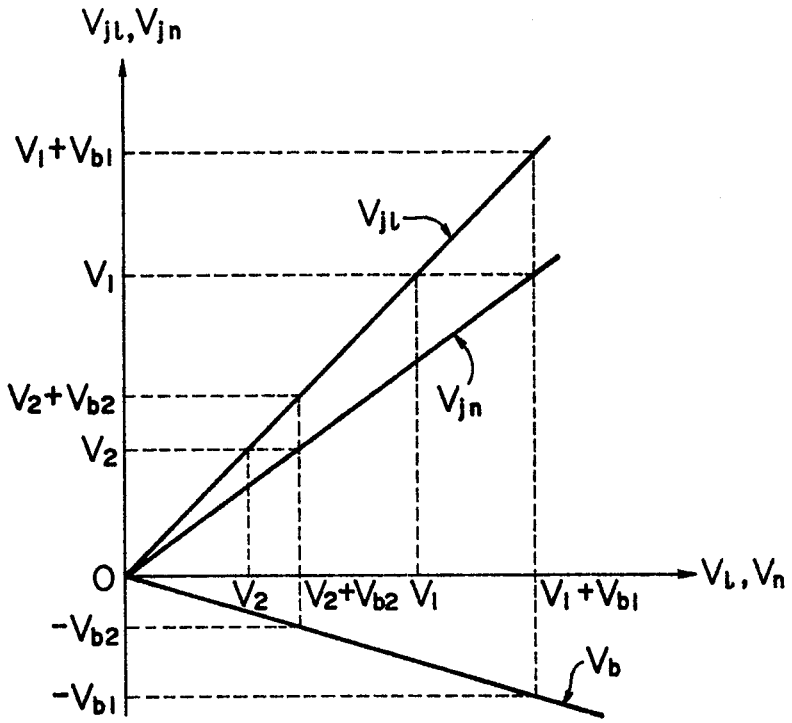
FIG. 9 is a time vs. speed pattern diagram showing the operation of the modification shown in FIG. 8.

In the embodiment of the present invention above described, the reference command voltage $V_b$ is obtained by dividing the command voltage VA by the variable resistor 35 so that it is variable depending on the speed of the elevator car. The same effect can be obtained in a modification shown in FIG. 8 although the variable resistor 35 is eliminated. In the modification shown in FIG. 8, the comparing circuit 34 includes input resistors 161 and 181 of different resistance values so that the inputs applied to input terminals 341 and 342 can be amplified at different rates. In a graph shown in FIG. 9, the horizontal axis represents input voltages $V_l$ and $V_n$ applied to the respective input terminals 341 and 342 of the comparing circuit 34, and the vertical axis represents corresponding output voltages $V_{jl}$ and $V_{jn}$ of the comparing circuit 34 expressed as a junction of the input voltages.

In this modification, the resistance value of the input resistor 161 is determined so that the value of $V_{jl}$ appearing at the output terminal 36 of the comparing circuit 34 is given by $(V_1 + V_{b1})$ when the input voltage $V_l$ given by $(V_1 + V_{b1})$ is applied to the input terminal 341 in the state in which the input $V_n$ is not applied to the input terminal 342. Further, the resistance value of the input resistor 181 is determined so that the value of $V_{jn}$ appearing at the output terminal 36 is given by $V_1$ when the input voltage $V_n$ given by $(V_1 + V_{b1})$ is applied to the input terminal 342 in the state in which the input $V_l$ is not applied to the input terminal 341. Thus, when $V_l$ has the level $V_1$, $V_{jl}$ is given by $V_1$, while when $V_n$ has the level $(V_1 + V_{b1})$, $V_{jn}$ is given by $V_1$. No output appears from the comparing circuit 34 when the two inputs thereto have the voltage difference of $V_{b1}$. It will be seen from FIG. 9 that the reference command voltage $V_b$ varies depending on the variation of the input $V_n$, that is, the command voltage input VA to the input terminal 342 of the comparing circuit 34. Therefore, the comparing circuit 34 in FIG. 8 has the same function as that shown in FIG. 6, and the speed command generator shown in FIG. 8 exhibits the same effect as that shown in FIG. 6.

What we claim is:

1. A speed command generator for an elevator comprising means for generating a first speed command signal varying depending on the distance between the existing position of an elevator car and the target floor position, means for generating a second speed command signal varying with the lapse of time in response to the application of the starting instruction to the elevator car, comparing means for comparing said first speed command signal with said second speed command signal thereby delivering an output when said first and second speed command signals satisfy a predetermined relationship, and means for storing the value of said second speed command signal in response to the appearance of the output from said comparing means, thereby to drive the elevator car according to a continuous speed pattern consisting of a sequence of speed patterns provided by said second speed command signal, said stored value and said first speed command signal, wherein the improvement comprises means for generating a reference command signal varying depending on the variation of said second speed command signal, said comparing means being responsive to said reference command signal for delivering an output when the difference between said first speed command signal and said second speed command signal is reduced to a value less than that of said reference command signal.

2. A speed command generator as claimed in claim 1, wherein said reference command signal generated by said generating means increases up to a predetermined level with the increase in said second speed command signal, and the rate of increase thereof decreases gradually upon attainment of the predetermined level.

3. A speed command generator as claimed in claim 1, wherein said reference command signal generated by said generating means increases up to a predetermined level in proportion to the increase in said second speed command signal and saturates at the predetermined level.

4. A speed command generator as claimed in claim 1, wherein said first speed command signal generated by said generating means is representative of a speed control characteristic determined depending on the distance between the existing position of the elevator car and the target floor position, so that the traveling speed of the elevator car can be reduced at a constant deceleration.

5. A speed command generator as claimed in claim 1, wherein said second speed command signal generated by said generating means appears in response to the application of the starting instruction to the elevator car and increases in proportion to the lapse of time.

6. A speed command generator for an elevator comprising means for generating a first speed command signal representative of a speed control characteristic determined depending on the distance between the existing position of an elevator car and the target floor position so as to reduce the traveling speed of the elevator car at a constant deceleration, means for generating a second speed command signal appearing in response to the application of the starting instruction to the elevator car and increasing in proportion to the lapse of time, comparing means for comparing said first speed command signal with said second speed command signal thereby delivering an output when said first and second speed command signals satisfy a predetermined relationship, and means for storing the value of said second speed command signal in response to the appearance of the output from said comparing means, thereby to drive the elevator car according to continuous speed patterns consisting of a sequence of speed patterns provided by said second speed command signal, said stored value and said first speed command signal, wherein the improvement comprises means for generating a reference command signal which increases up to a predetermined level with the increase in said second speed command signal and the rate of increase of which decreases gradually upon attainment of the predetermined level, said comparing means delivering the output when the difference between said first speed command signal and said second speed command signal is reduced to a value less than that of said reference command signal.

7. A speed command generator as claimed in claim 6, wherein said generating means for generating said reference command signal comprises voltage divider means connected to the output of said means for generating said second speed command signal.

8. A speed command generator as claimed in claim 7, wherein said voltage divider means is connected to the input of said comparator means to apply said reference command signal thereto.

9. A speed command generator as claimed in claim 6, wherein said generating means for generating said reference command signal comprises first and second resistors connecting said first and second speed command signals to the input of said comparator means, respectively, said first and second resistors having different resistance values in a predetermined relationship.

* * * * *